US011772854B2

(12) United States Patent
Zhang et al.

(10) Patent No.: US 11,772,854 B2
(45) Date of Patent: Oct. 3, 2023

(54) STORAGE BOX

(71) Applicant: GENICOOK PRODUCT LLC, Garland, TX (US)

(72) Inventors: Jianzhong Zhang, Handan (CN); Xiaojia Liu, Handan (CN)

(73) Assignee: GENICOOK PRODUCT LLC, Garland, TX (US)

( * ) Notice: Subject to any disclaimer, the term of this patent is extended or adjusted under 35 U.S.C. 154(b) by 0 days.

(21) Appl. No.: 17/701,718

(22) Filed: Mar. 23, 2022

(65) Prior Publication Data

US 2022/0212839 A1 Jul. 7, 2022

(51) Int. Cl.
*B65D 43/02* (2006.01)
*B65D 25/04* (2006.01)

(52) U.S. Cl.
CPC ..... *B65D 43/0218* (2013.01); *B65D 25/04* (2013.01); *B65D 2543/00101* (2013.01); *B65D 2543/00194* (2013.01); *B65D 2543/00296* (2013.01); *B65D 2543/00509* (2013.01); *B65D 2543/00537* (2013.01); *B65D 2543/00555* (2013.01)

(58) Field of Classification Search
CPC ..... B65D 43/0218; B65D 2543/00101; B65D 2543/00194; B65D 2543/00296; B65D 2543/00509; B65D 2543/00537; B65D 2543/00555; B65D 25/06; B65D 25/04
See application file for complete search history.

(56) References Cited

U.S. PATENT DOCUMENTS

| | | | | |
|---|---|---|---|---|
| 2007/0218756 | A1 | 9/2007 | Takemoto et al. | |
| 2014/0124515 | A1 | 5/2014 | Kabe et al. | |
| 2015/0014309 | A1 | 1/2015 | Li et al. | |
| 2019/0233177 | A1* | 8/2019 | Han | B65D 81/3818 |
| 2020/0148421 | A1* | 5/2020 | Hutton | B65D 1/22 |
| 2020/0189829 | A1* | 6/2020 | Han | B65D 25/06 |
| 2020/0262611 | A1* | 8/2020 | Siskindovich | B65D 25/06 |
| 2020/0323330 | A1* | 10/2020 | Patel | A45C 11/008 |
| 2021/0053741 | A1* | 2/2021 | Barfoot | B65D 81/3823 |

* cited by examiner

*Primary Examiner* — Shawn M Braden
(74) *Attorney, Agent, or Firm* — Zhigang Ma

(57) ABSTRACT

The present invention discloses a storage box, comprising a box body and a cover body which is covered on the top of the box body, and further comprising a partition component. The partition component comprises a first silica gel sealing strip frame, a second silica gel sealing strip frame and a hard partition plate; the inner wall of the first silica gel sealing strip frame is provided with a first groove; the first silica gel sealing strip frame is placed vertically inside the box body; the outer wall of the first silica gel sealing strip frame is attached to the inner wall of the box body; the inner wall of the second silica gel sealing strip frame is provided with a second groove; the hard partition plate is provided with third grooves on both corresponding sides near the top.

2 Claims, 3 Drawing Sheets

STORAGE BOX

TECHNICAL FIELD

The present invention relates to the technical field of storage devices, and particularly relates to a storage box.

BACKGROUND

The storage box is an appliance used for storing and collecting things. For the convenience of classification and storage of different articles, a partition plate is generally arranged in the storage box.

However, the existing partition plate is fixed in the storage box. The size of each storage case cannot be adjusted, causing inconvenience of use.

Thus, the problem to be solved by those skilled in the art is how to provide a storage box with convenient usage.

SUMMARY

In view of this, the present invention provides a storage box which can adjust the space sizes of storage cases to adapt to use needs.

To achieve the above purpose, the present invention adopts the following technical solution:

A storage box includes a box body and a cover body which is covered on the top of the box body, and further includes a partition component. The partition component comprises a first silica gel sealing strip frame, a second silica gel sealing strip frame and a hard partition plate; the inner wall of the first silica gel sealing strip frame is provided with a first groove; the first silica gel sealing strip frame is placed vertically inside the box body; the outer wall of the first silica gel sealing strip frame is attached to the inner wall of the box body; the inner wall of the second silica gel sealing strip frame is provided with a second groove; the top of the outer wall of the second silica gel sealing strip frame is attached to the inner wall of the cover body; the hard partition plate is provided with third grooves on both corresponding sides near the top; the bottom and the middle of the hard partition plate are embedded in the first groove; the top of the hard partition plate is embedded in the second groove; and both ends of the second silica gel sealing strip frame are clamped in the two third grooves.

By adopting the above technical solution, the present invention has the following beneficial effects:

1) The first silica gel sealing strip frame and the second silica gel sealing strip frame are enclosed on the periphery of the hard partition plate. The position of the partition component can be artificially moved according to the needs, to adjust the space sizes of storage cases and make the operation simple and the use convenient.

2) The hard partition plate is embedded in the first groove and the second groove. Both ends of the second silica gel sealing strip frame are clamped in the third grooves, thereby enhancing the entire stability and making it difficult to fall off.

Further, the partition component also comprises a plurality of suckers; the plurality of suckers are integrally connected with the outer wall of the first silica gel sealing strip frame, and evenly distributed; and the outer wall of the first silica gel sealing strip frame is attached to the inner wall of the box body through the plurality of suckers.

The beneficial technical effects produced by adopting the above further technical solution are: the adsorption with the inner wall of the box body is enhanced and easy falling is avoided.

DESCRIPTION OF DRAWINGS

To more clearly describe the technical solutions in the embodiments of the present invention or in the prior art, the drawings required to be used in the description of the embodiments or the prior art will be simply presented below. Apparently, the drawings in the following description are merely embodiments of the present invention, and for those ordinary skilled in the art, other drawings can also be obtained according to the drawings without contributing creative labor.

DETAILED DESCRIPTION

The technical solutions in the embodiments of the present invention will be clearly and fully described below in combination with the drawings in the embodiments of the present invention. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

Figure 1:
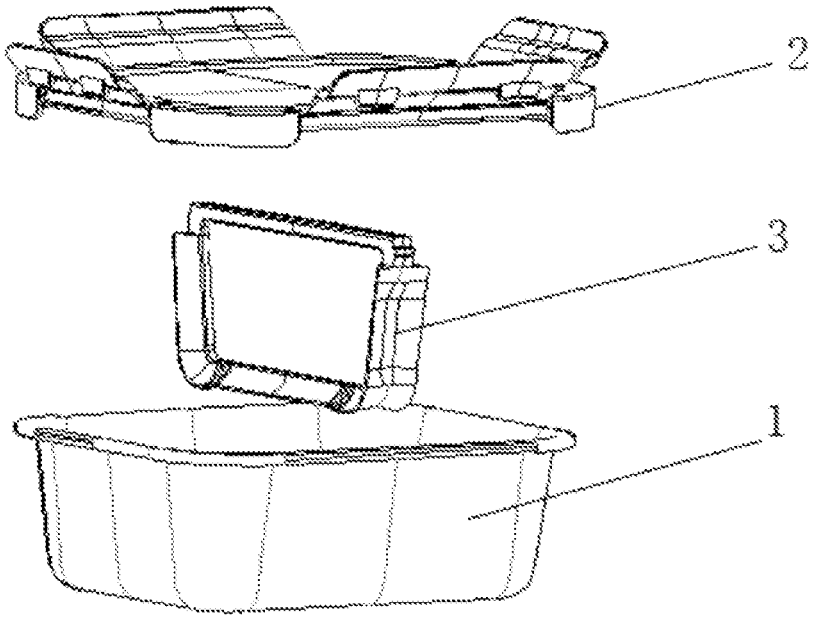
FIG. 1 is an explosive view of a storage box provided by the present invention.
Figure 2:
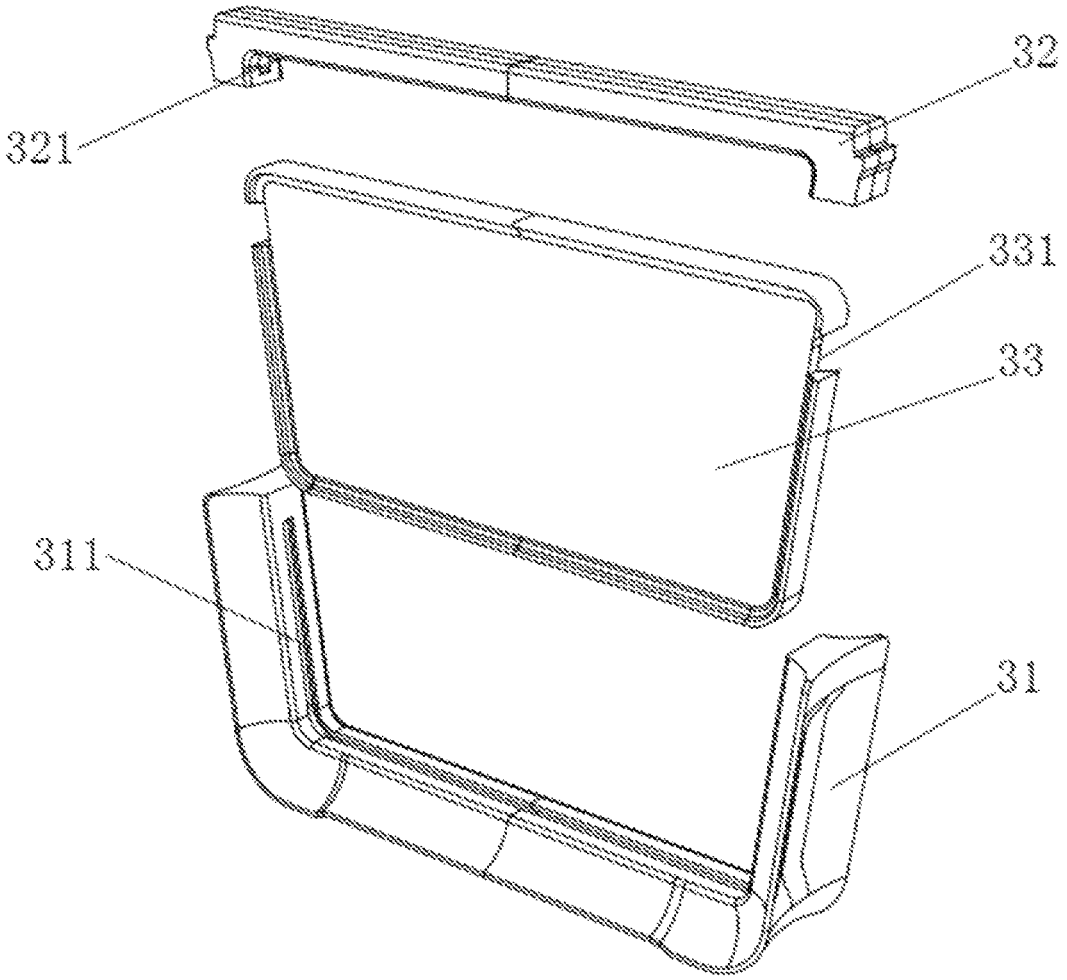
FIG. 2 is an explosive view of a partition component without sucker provided by the present invention.
Figure 3:
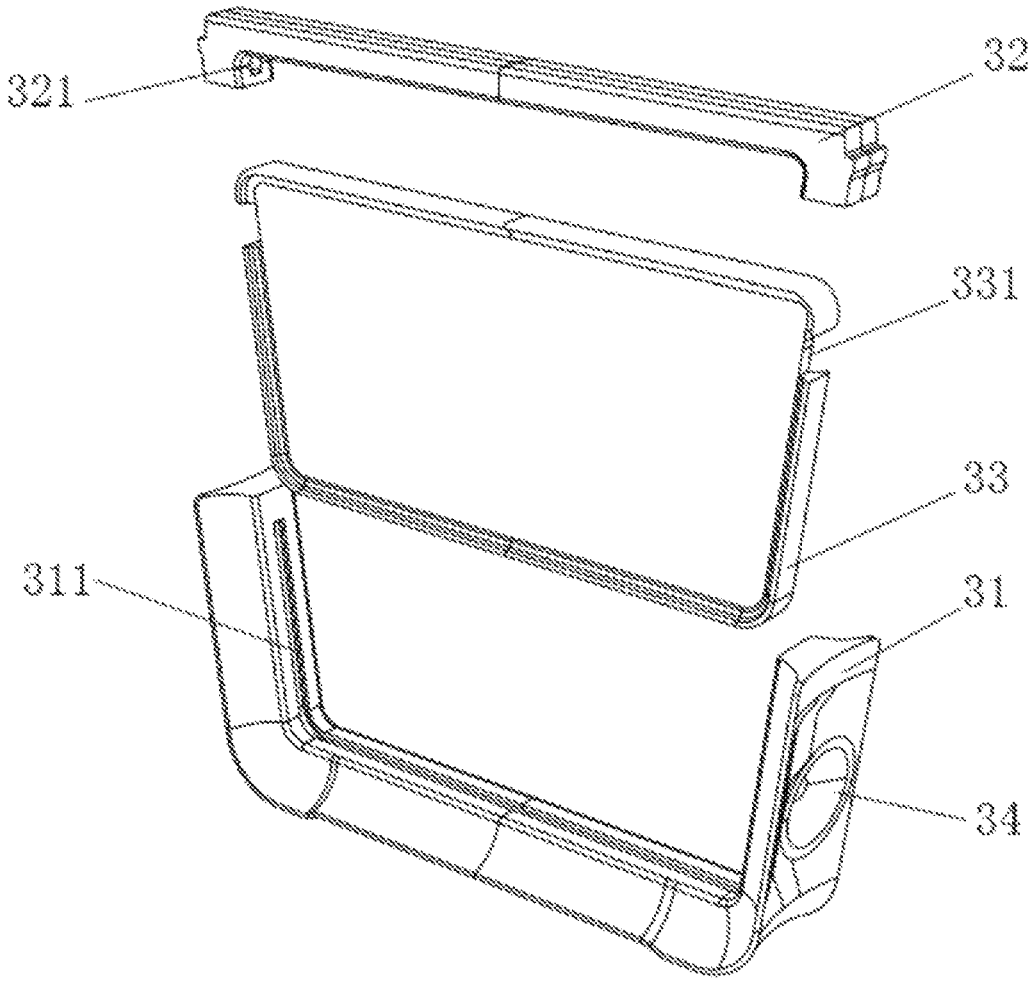
FIG. 3 is an explosive view of a partition component with sucker provided by the present invention.

As shown in FIGS. 1-3, embodiments of the present invention disclose a storage box, including a box body 1 and a cover body 2 which is covered on the top of the box body 1, and further including a partition component 3. The partition component 3 includes a first silica gel sealing strip frame 31, a second silica gel sealing strip frame 32 and a hard partition plate 33; the inner wall of the first silica gel sealing strip frame 31 is provided with a first groove 311; the first silica gel sealing strip frame 31 is placed vertically inside the box body 1; the outer wall of the first silica gel sealing strip frame 31 is attached to the inner wall of the box body; the inner wall of the second silica gel sealing strip frame 32 is provided with a second groove 321; the top of the outer wall of the second silica gel sealing strip frame 32 is attached to the inner wall of the cover body 2; the hard partition plate 33 is provided with third grooves 331 on both corresponding sides near the top; the bottom and the middle of the hard partition plate 33 are embedded in the first groove 311; the top of the hard partition plate 33 is embedded in the second groove 321; and both ends of the second silica gel sealing strip frame 32 are clamped in the two third grooves 331.

In the present invention, the first silica gel sealing strip frame 31 and the second silica gel sealing strip frame 32 are enclosed on the periphery of the hard partition plate 33. The position of the partition component 3 can be artificially moved according to the needs, to adjust the space sizes of storage cases and make the operation simple and the use convenient. The hard partition plate 33 is embedded in the first groove 311 and the second groove 321. Both ends of the second silica gel sealing strip frame 32 are clamped in the third grooves 331, thereby enhancing the entire stability and making it difficult to fall off.

Specifically, the partition component 3 also includes a plurality of suckers 34; the plurality of suckers 34 are integrally connected with the outer wall of the first silica gel sealing strip frame 31, and evenly distributed; and the outer wall of the first silica gel sealing strip frame 31 is attached to the inner wall of the box body 1 through the plurality of suckers 34.

Each embodiment in the description is described in a progressive way. The difference of each embodiment from each other is the focus of explanation. The same and similar parts among all of the embodiments can be referred to each other. For a device disclosed by the embodiments, because the device corresponds to a method disclosed by the embodiments, the device is simply described. Refer to the description of the method part for the related part.

The above description of the disclosed embodiments enables those skilled in the art to realize or use the present invention. Many modifications to these embodiments will be apparent to those skilled in the art. The general principle defined herein can be realized in other embodiments without departing from the spirit or scope of the present invention. Therefore, the present invention will not be limited to these embodiments shown herein, but will conform to the widest scope consistent with the principle and novel features disclosed herein.

What is claimed is:

1. A storage box, comprising a box body and a cover body which is covered on the top of the box body, and further comprising a partition component, wherein the partition component comprises a first silica gel sealing strip frame, a second silica gel sealing strip frame and a hard partition plate; an inner wall of the first silica gel sealing strip frame is provided with a first groove; the first silica gel sealing strip frame is placed vertically inside the box body; an outer wall of the first silica gel sealing strip frame is attached to an inner wall of the box body; an inner wall of the second silica gel sealing strip frame is provided with a second groove; a top of an outer wall of the second silica gel sealing strip frame is attached to an inner wall of the cover body; the hard partition plate is provided with third grooves on both corresponding sides near the top; a bottom and a middle of the hard partition plate are embedded in the first groove; the top of the hard partition plate is embedded in the second groove; and both ends of the second silica gel sealing strip frame are clamped in two third grooves.

2. The storage box according to claim 1, wherein the partition component also comprises a plurality of suckers; the plurality of suckers are integrally connected with the outer wall of the first silica gel sealing strip frame, and evenly distributed; and the outer wall of the first silica gel sealing strip frame is attached to the inner wall of the box body through the plurality of suckers.

* * * * *